US005174617A

United States Patent [19]

Huber et al.

[11] Patent Number: 5,174,617

[45] Date of Patent: Dec. 29, 1992

[54] LATCH FOR "SLIDING" DOOR OR WINDOW

[75] Inventors: Mark G. Huber, Yucca Valley; Davie G. Hutchison; David M. Prochaska, both of Oceanside, all of Calif.

[73] Assignee: Slideline, Inc., Oceanside, Calif.

[21] Appl. No.: 836,607

[22] Filed: Feb. 18, 1992

[51] Int. Cl.[5] ..... E05C 13/14

[52] U.S. Cl. ..... 292/128; 292/106; 292/108; 292/DIG. 46

[58] Field of Search ..... 292/DIG. 46, 336, 106, 292/108, 121, 128, 207, 210, 219, 228

[56] References Cited

U.S. PATENT DOCUMENTS

| | | | |
|---|---|---|---|
| 1,162,121 | 11/1915 | Wright et al. | 292/336 X |
| 1,173,347 | 2/1916 | Goessling | 292/104 X |
| 3,117,811 | 1/1964 | Duvall | 292/DIG. 46 |
| 3,352,586 | 11/1967 | Hakanson | 292/DIG. 46 |
| 4,014,572 | 3/1977 | Binns | 292/108 |
| 4,647,088 | 3/1987 | Nelson | 292/104 X |

*Primary Examiner*—Richard E. Moore
*Attorney, Agent, or Firm*—Brown, Martin, Haller & McClain

[57] ABSTRACT

A latch mechanism for a sliding door or window. The latch includes a striker (normally mounted on the door or window frame); a housing aligned with the striker (and normally mounted on the sliding door or window panel) and with walls forming an interior chamber; one opening in the front of the chamber and a second opening at least partially in the back of the chamber; and a spindle and a pivot pin disposed transversely within the chamber; an elongated latch bar pivotally mounted on the spindle, with its front end projecting out of the first opening and its back end projecting out of the second opening. Its front end can be releasably latched to the striker in response to motion of its back end. Also included is a hold-open bar for preventing engagement of the latch bar with the striker, a deadbolt abutting the latch bar, a guide to permit the deadbolt to extend and retract though the first opening, so that when the deadbolt cooperates with the striker and prevent the latch bar from pivoting on the spindle and the moveable panel from being removed from the door frame. Separate springs urge the latch bar into a latched configuration and the hold-open bar into a disengaged position. The latch can be reversible and used interchangeably with both right- and left-hand opening doors or windows. Also, it can be mounted on the surface of the door and panel frames or mounted internally of those frames.

15 Claims, 2 Drawing Sheets

LATCH FOR "SLIDING" DOOR OR WINDOW

BACKGROUND OF THE INVENTION

1. Field of the Invention

The invention herein relates to door and window latches, especially for sliding, pocket or bifold doors or windows.

2. Background Description

Sliding, pocket and bifold doors and windows have been fixtures of residential and commercial buildings for many years. For brevity throughout this application, such doors and windows and related structures will sometimes be referred to generically as "closures" and the embodiment exemplified and discussed will be a door. It will be understood, of course, that the invention applies equally to all such closures. Also for brevity, the term "sliding door" or "sliding closure," as used in the Specification and the claims herein, will be inclusive of all closures in which the closure at the point of final approach to the jamb moves in a plane perpendicular to the face of the jamb, rather than moving in a plane parallel to the face of the jamb as in characteristic of most "swinging" or "rollup" doors. Thus, for the purposes of this invention, the term "sliding door" encompasses not only those closures commonly classified in the trade as "sliding" (including those which commonly incorporate small caster wheels so that both rolling and sliding motions are involved), but also those normally referred to as "bifold," "pocket," "accordian," "folding" and similar designations.

Commonly the sliding door is formed of a door frame attached to the building structure and which includes two parallel internal U-shaped tracks in the top and bottom of the door frame. One-half of the door frame is occupied by a stationary panel, normally with its own frame surrounding an interior sheet of glass or screen, which is fixed in one track. The other half of the door frame is occupied by a moveable (sliding) panel, also with its own frame and interior sheet of glass or screen, which is seated in the second track and can be slid parallel to and past the fixed panel to open or close the door. As noted, smaller closures, particularly windows, have a moveable panel which only slides in its track, while larger closures, particularly doors, commonly incorporate small castor wheels into the bottom (and sometimes top) of the panel frame so that the moveable panel to some extent rolls in the track as well as slides.

It is normal practice to make the moveable panel slightly undersized as compared to the door frame, so that while the moveable panel is retained in the U-shaped tracks by contact at both its bottom and top, there is normally a small gap between the top of the moveable panel and the base of the top track. This allows one to remove the moveable panel from the door frame by lifting it slightly so that the bottom edge of the panel clears the lower track and the panel can then be swung outwardly and removed entirely from the door frame. This facilitates cleaning of the door, repair or replacement of damaged glass or screens, and interchange of moveable glass and screen panels when the seasons change.

In addition, the necessary ability to remove the moveable panel from the frame also creates a security risk, since it is also possible for a criminal to lift the door out of the track and thus gain entry a home, motel room or other place where such a door is mounted. In the past, there have been a number of proposals for preventing the door from being removed from the track other than when removal is desired by the occupant of the building. However, many such proposed devices have been cumbersome, unattractive or ineffective.

In recent years there has been considerable concern about the safety of home and motel swimming pools, to which people commonly have access from inside a house or motel room by means of a sliding door. There have been a number of unfortunate incidents where small children have gone out through the sliding door and have fallen into the pool and drowned before other occupants of the house realized the children had opened the door and gone out to the pool area. Consequently, a number of states, counties and municipalities are currently considering enacting building and safety regulations which would require new residential and commercial construction to make all sliding doors which open to a pool area close promptly and automatically after being opened. Retrofitting existing pool access sliding doors is also under consideration. (A unique and highly effective mechanism for automatic closure of sliding doors is described and claimed in pending U.S. patent application Ser. No. 07/724,822, filed by D.G. Hutchison and D.M. Prochaska on Jul. 2, 1991, and to which the latch of this invention is applicable.) Such automatically closing doors must, of course, have latch mechanisms which are automatically secured upon closure.

It would therefore be advantageous to have a latch mechanism which provides for simple and secure latching automatically when the sliding door is closed, which permits the door to be secured from attempts to remove it from the track, which can be easily unlatched when desired, and which is readily adaptable to sliding doors and windows of various configurations and which functions equally well whether the door or window closes and latches to the left or to the right. It would also be desirable to have means incorporated in the latch to prevent the door from being unlatched inadvertently or without authorization and to permit the latch to be held open when desired so that the door would not inadvertently become latched. It would also be advantageous to have the latch be capable of serving as either the main latching mechanism for the door or as an auxiliary (or "safety") latch which is incorporated into the door in addition to the main latching mechanism.

SUMMARY OF THE INVENTION

The invention herein is a latch mechanism for a sliding door or window. Broadly defined, the latch includes a striker (normally mounted on the door or window frame); a housing aligned with the striker (and normally mounted on the sliding door or window panel) and with walls forming an interior chamber; one opening in the front of the chamber and a second opening at least partially in the back of the chamber; and a spindle and a pivot pin disposed transversely within the chamber; an elongated latch bar pivotally mounted on the spindle, with its front end projecting out of the first opening and its back end projecting out of the second opening. Its front end can be releasably latched to the striker in response to motion of its back end. Also included is a hold-open bar for preventing engagement of the latch bar with the striker, a deadbolt abutting the latch bar, a guide to permit the deadbolt to extend and retract though the first opening, so that when the deadbolt cooperates with the striker and prevents the latch bar from pivoting on the spindle and the moveable panel from being removed from the door frame. Separate springs urge the latch bar into a latched configuration and the hold-open bar into a disengaged position. The latch can be reversible and used interchangeably with both right- and left-hand opening doors or windows. Also, it can be mounted on the surface of the door and panel frames or mounted internally of those frames latch mechanism for a sliding door or window is described, to function with a door frame with a sliding panel mounted therein. Further, the latch can be used as the only latching and locking mechanism for the door or as an auxiliary latching and locking mechanism.

More specifically, the latch apparatus of this invention is for a sliding closure, the closure having a frame and a panel slidably and closably mounted in the frame, the latch apparatus comprising a striker mounted on one of the frame and the panel; a housing mounted on the other of the frame and the panel in alignment with the striker, the housing having opposed faces and a peripheral wall therebetween, the faces and wall forming a chamber within the housing, and the wall having a front and a back; a first opening in the front of the wall and a second opening at least partially in the back of the wall; and spindle means and a pivot pin disposed transversely between the faces within the chamber; an elongated latch bar having a front end and a back end and pivotally mounted on the spindle means in the chamber, with the front end projecting out of the first opening and the back end projecting out of the second opening; the front end having means therein for releasable latching engagement with the striker, the engagement being responsive to motion of the back end; and means cooperating with hold-open means for preventing the engagement with the striker; an elongated deadbolt abutting the latch bar and having an inner end and an outer end; guiding means adjacent the inner end pivotally engaging track means in the faces of the housing to permit the deadbolt to extend and retract though the first opening; when extended to project into the striker and prevent the latch bar from pivoting on the spindle means; and when retracted to pivot when the latch bar is pivoted; elongated hold-open means pivotally mounted on the pivot pin with a first end projecting outwardly though the second opening and a second end disposed to be pivotally moved by movement of the first end between a position of engagement with the latch bar when the latch bar is disengaged from the striker and a position of disengagement with the latch bar, the hold-open means when engaged with the latch bar preventing the latch bar from engaging the striker; and first and second resilient urging means, the first urging means urging the latch bar into a latched configuration and the second urging means urging the hold-open means into the position of disengagement.

In preferred embodiments, the latch apparatus also includes having means incorporated into the striker cooperative with the deadbolt to prevent the panel from being removed from the frame.

The latch mechanism of this invention can be reversible and used interchangeably with both right- and left-hand opening doors or windows. Also, it can be mounted on the surface of the door and panel frames or mounted internally of those frames.

DETAILED DESCRIPTION AND PREFERRED EMBODIMENTS

Figure 7:
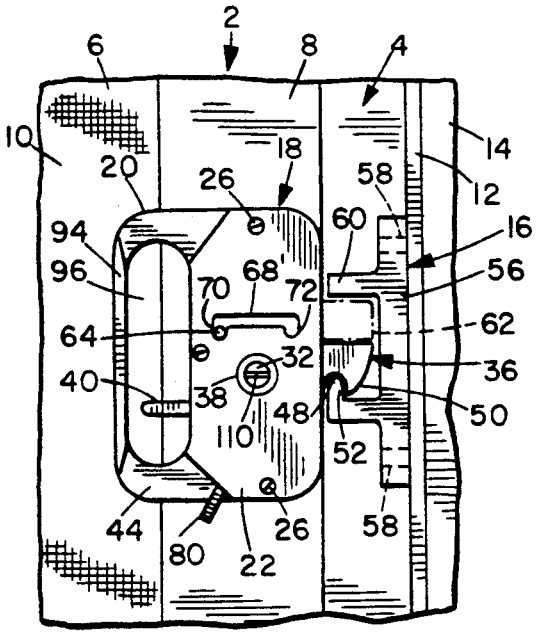
FIG. 7 is a partial elevation view of a handle of this invention in place on the inside of a screen door.
Figure 8:
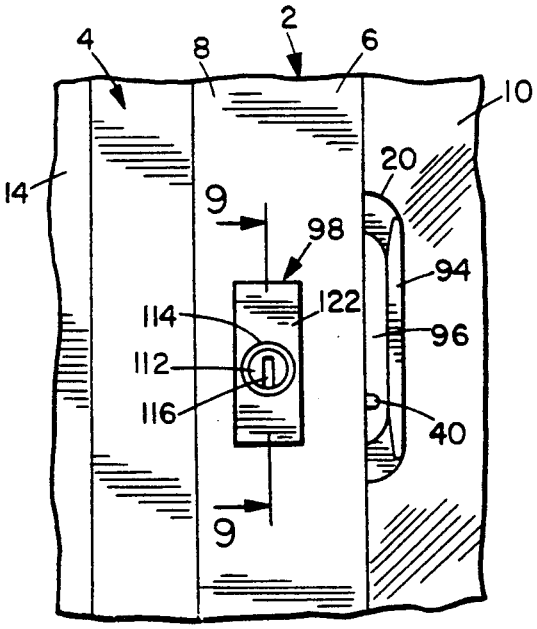
FIG. 8 is a partial elevation view of a latch mechanism of this invention in place on a sliding glass door, as viewed from outside the door.

The present invention is best understood by reference to the drawings, considering first FIGS. 7 and 8, in which are illustrated a portion of the vertical door frame 4 of a sliding door 2 (which may be a conventional sliding door or an automatic closure sliding door). Mounted within the frame 4 is a moveable door panel 6 which is composed of a peripheral panel frame 8 surrounding the enclosed sheet 10 (the sheet 10 being indicated as screen in FIG. 7 and glass in FIG. 8). The door is opened by moving the panel 6 to the left as viewed from inside the room. (It will be understood that the drawings also represent a right-opening door, merely by having the views inverted. Reversal of the mechanism itself will be discussed below.) Door frame 4 has a projecting portion 12 which abuts wall 14 and is secured to the wall in the conventional manner of framing of a door.

Mounted on the projecting portion 12 of door frame 4 is striker 16 which will be discussed further below. Mounted on panel frame 8 and aligned with striker 16 is latch 18 which is seated on handle 20, both of which are secured to panel frame 8.

Figure 1:
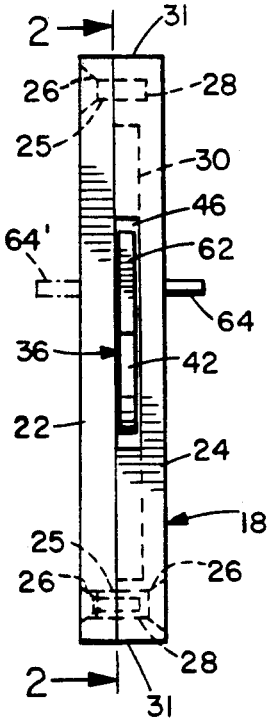
FIG. 1 is an end elevation view of the latch mechanism of this invention viewed from the end adjacent to the edge of the window or door.
Figure 2:
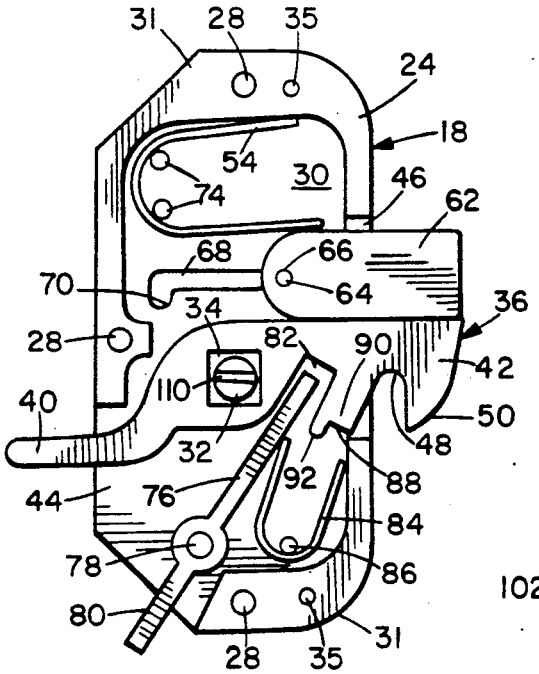
FIG. 2 is an elevation of the internal structure of the latch of this invention, taken on Line 2—2 of FIG. 1. In this figure, the latch is shown as in the position when the door or window would be closed and locked.
Figure 3:
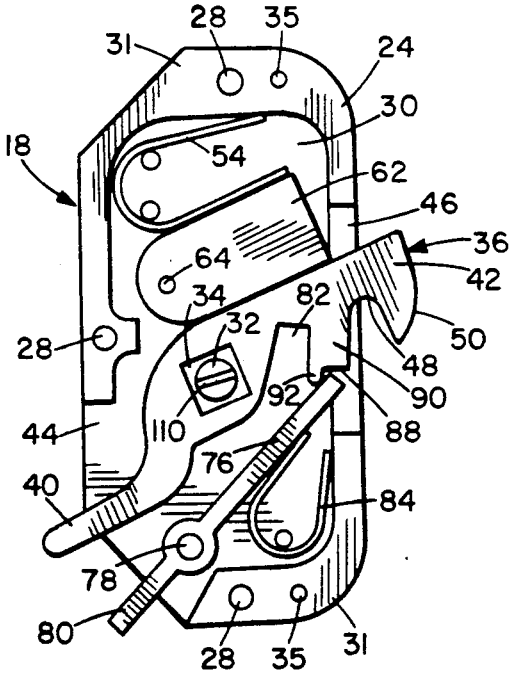
FIG. 3 is an elevation view similar to that of FIG. 2, but showing the mechanism in an unlatched configuration with the mechanism being temporarily secured against relatching.
Figure 5:
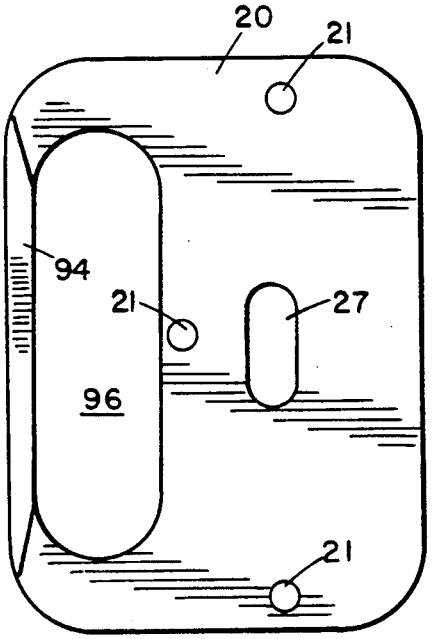
FIG. 5 is a front elevation view of the door handle associated with the latch of this invention.

FIGS. 1, 2 and 3 best illustrate the latching mechanism of the present invention. The housing of latch 18 is conveniently made in two portions, designated cover 22 and casing 24, which are secured together in a separable manner as by bolts 26 passing through holes 25 in cover 22 and being seated in holes 28 in casing 24. Alternatively holes 28 could be through to the exterior of casing 24 as at 28' and double-headed male-female bolts 26' could be used to secure cover 22 and casing 24. Alignment of cover 22 and casing 24 may be aided by the presence of alignment pins 35. Typically the housing will be on the order of $3\frac{1}{4}$ inches high by $1\frac{1}{2}$ inches wide by $\frac{1}{2}$ inch thick (8.2×3.8× 1.2 cm), although of course these dimensions may be varied to accommodate different door configurations.

Figure 10:
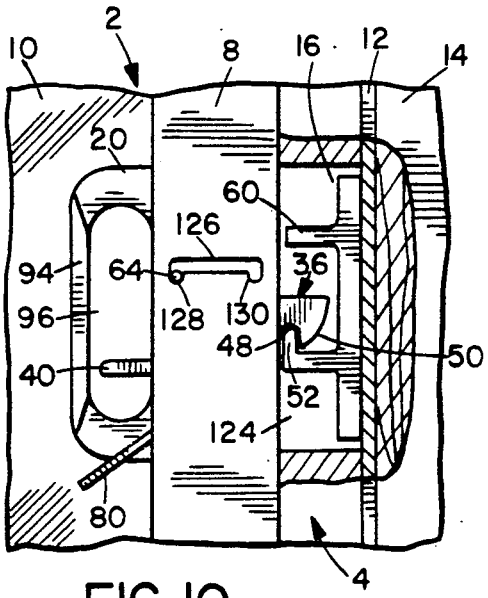
FIG. 10 is an elevation view similar to that of FIG. 7, but showing in partially cut-away a door structure in which the latch mechanism of this invention is housed within the door and panel frame rather than being mounted on the exterior of the frame.
Figure 11:
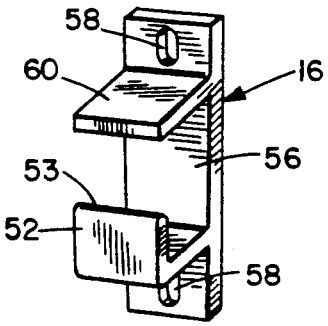
FIG. 11 is a perspective view of a striker useful in this invention.

The interior of casing 24 is hollowed out interiorly of walls 31 to provide a chamber 30 in which are seated the operating components of the latch 18. Mounted centrally and laterally of chamber 30 and spanning between the outer wall of casing 24 and the underside of cover 22 is rotatable spindle 32 which is secured in opening 34 in latch bar 36 and journaled at each end to rotate in bearings 38 mounted in cover 22 and casing 24. Mounted on spindle 32 is latch bar 36. Latch bar 36 is elongated to provide at its inner end a thumb or finger tab 40 and at its outer end a hook 42. The inner end of latch bar 36 projects outwardly from casing 24 through opening 44 while the outer end of latch bar 36 formed as hook 42 projects outwardly from casing 24 through opening 46. Hook 42 has two functional segments, a recess 48 and a curved nose 50. Recess 48 engages with an upraised catch 52 on striker 16 when the door is in a closed and latched position as shown in FIGS. 7 and 10. The top end 53 of catch 52 is rounded, and the nose 50 is curved or beveled, to allow latch bar 36 to easily ride upward and over catch 52 as the door is closing. As the outer portion of the latch bar 36 traverses over catch 52 and catch 52 becomes aligned with recess 48, a spring 54 urges the latch bar 36 downward so that recess 48 and catch 52 become interlocked.

Striker 16 is mounted on the upraised portion 12 of the door frame 4. It is formed of a base 56 having therein mounting slots 58 to receive conventional mounting screws; slots 58 are elongated to allow for vertical alignment of striker 16 with latch bar 36 during installation. Catch 52 extends outwardly from base 56 and functionally engages recess 48 in latch bar 36 as described. Also extending outwardly from base 56 above catch 52 is security projection 60 whose function will be described below.

Housed in casing 24 is deadbolt 62 which rests on the top of and is adapted to slide back and forth along latch bar 36, its travel being restrained by pin 64 which is fitted into hole 66 and which slides in slots 68 and 68' in casing 24 and cover 22, respectively. Pin 64 is fitted into hole 66 with a very slight interference fit, so that it can be moved axially in hole 66 by relatively light finger pressure, but is not sufficiently loose to disengage from hole 66 during normal use. This permits the outwardly extending portion of pin 64 to be shifted from one side of the latch 18 to the other side, as shown in FIG. 1 in positions 64 and 64', respectively, which in turn permits the latch mechanism 18 to be reversed to accommodate both left-handed and right-handed opening doors.

When deadbolt 62 is extended as shown in FIGS. 2 and 7, it substantially fills the space remaining between catch 52 and security projection 60 of striker 16 which is not occupied by the outer end of latch bar 36. A slight clearance remains between the underside of security projection 60 and the top of deadbolt 62. However, the clearance is sufficiently small that deadbolt 62 and latch bar 36 occupying the space between catch 22 and security projection 60 prevents the moveable panel 6 from being lifted out of its track, since latch bar 36 cannot be disengaged from catch 52 of striker 16 while deadbolt 62 is in its extended position.

When deadbolt 62 is retracted into casing 24, as shown in FIGS. 3 and 10, latch bar 36 can then be rotated upwardly by pressure on tab 40 to disengage from recess 48 from catch 52 and allow the moveable door panel 6 to be opened.

Slots 68 and 68' conveniently also have end recesses 70 and 72 which extend downwardly from slots 68 and 68' and into which pin 64 can drop to enable the deadbolt 62 to be retained in a retracted or extended position, as desired, and to prevent inadvertent or unauthorized retraction or extension of deadbolt 62.

U-shaped compression spring 54 rests on the top of deadbolt 62 and at its other end engages the inner wall of recess 24 and is secured in place by fixed pins 74. When the latch bar 36 and deadbolt 52 are raised as shown in FIG. 3, spring 54 is compressed and resiles to urge deadbolt 62 and latch bar 36 back into a horizontal position, which is the normal rest position of the mechanism.

Also, within casing 24 is hold-open bar 76 which is pivotally mounted on pin 78 and has an outer end extending outwardly through opening 44 to form thumb or finger tab 80. Comparison of FIGS. 2 and 3 illustrates the operation of hold-open bar 76. When the latch bar 36 is to be freely moveable between its latched and unlatched position, hold-open bar 76 is aligned as shown in FIG. 2 and extends loosely into recess 82 in the underside of latch bar 36. Hold-open bar 76 is normally retained in this disengaged position by the action of U-shaped compression spring 84 which engages the bottom of latch bar 76 and the inside wall of casing 24 and is secured in place by pin 86. When it is desired to retain latch bar 36 in a disengaged or opened position, however, hold-open bar 76 is moved to the position shown in FIG. 3 where it compresses spring 84 and engages the underside of shoulder 88 formed at the bottom of projection 90 in latch bar 36 and is retained in position by the compressive resilience of spring 84. Tab 92 behind shoulder 88 prevents latch bar 76 from sliding out of engagement with shoulder 88. To release the latch bar, one needs only to push down slightly on tab 40 to allow tab 92 to clear the end of hold-open bar 76 and the resilience of spring 84 will return latch bar 76 to its disengaged position as shown in FIG. 2, thus allowing latch bar 36 to again be freely raised and lowered.

Also included in the present structure is reversible handle plate 20 which, as noted, mounts between the latch housing 18 and the door frame 8. It is secured to door frame 8 by means of screws passing though holes 21. Slot 27 provides clearance for the external activation mechanism 98 as will be described below; it is elongated symmetrically so that when turned over (reversed) the mechanism 98 will still be accessible. Similarly, the holes 21, 25 and 28 are also aligned symmetrically to permit reversal of the mechanism. Handle 20 includes a raised portion 94 and an opening 96 to allow the user's fingers to engage the handle 20 and open or close the door panel 6.

Figure 4:
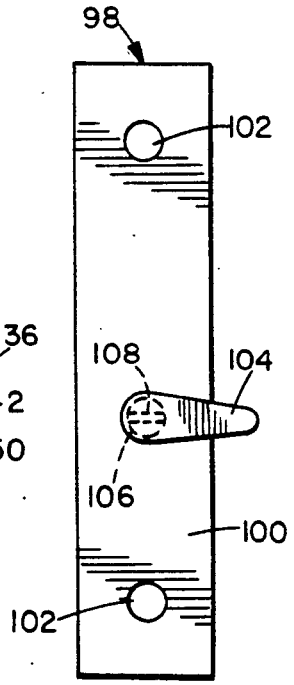
FIG. 4 is a front elevation view of a portion of the apparatus which allows the door to be unlatched from the outside.
Figure 6:
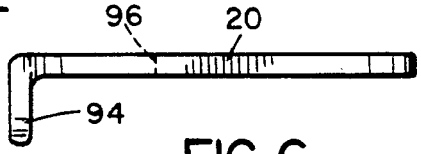
FIG. 6 is a top plan view of the handle of FIG. 5.
Figure 9:
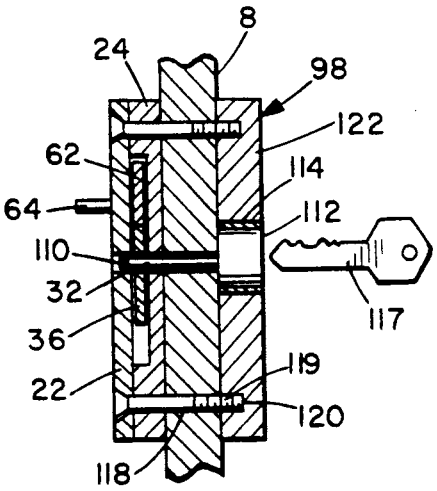
FIG. 9 is a partial sectional view taken on Line 9—9 of FIG. 8 showing the latch of this invention used with an exterior lock mechanism.

Mounted on the external side of frame 8 of moveable door panel 6 is latch activating mechanism 98 which is best illustrated in FIGS. 4, 9 and 10. Mechanism 98 shown in FIG. 4 comprises a simple plate 100 which can be mounted to frame 8 by screws passing through holes 102. The mechanism itself is activated by lever 104 which is rotatably mounted in hole 106 in plate 100 and has a tongue 108 extending outwardly therefrom into engagement with slots with 110 in spindle 32, such that the user's pushing downward on lever 104 causes upward rotation of latch bar 36 through motion of spindle 32. As an alternative, shown in FIGS. 8 and 9, the lever 104 can be replaced by a cylinder lock 112 which is journaled to rotate in cylinder housing 114 and includes keyway 116 to accommodate key 117. Thus in this alternative embodiment the user must use door key 117 to unlatch the door from the outside, rather than being able to use simple finger pressure on lever 104. The security of the lock configuration is enhanced by mounting the lock from the rear as shown in FIG. 9, as by using bolts 119 which are passed through holes 118 and are threadedly secured in holes 120 in the lock housing 122, which replaces panel 100 used with the lever 104 embodiment.

While in the above examples, the mechanism 18 has been shown as mounted on the outside of frames 4 and 8, it can also be mounted internally of the frames for appearance or security purposes, as illustrated in FIG. 10. In this case, the striker 16 is mounted in a mortise or recess 124 in frame 4 (as shown in partial cut away), while the latch mechanism 18 is positioned between the inner and outer walls of frame 8. In addition to slots 68 and 68', an additional slot 126 is formed in frame 8 and also includes recesses 128 and 130 corresponding to recesses 70 and 72 to secure pin 64 as described above.

The latch of the present invention may be mounted at the ordinary door latch height of about 36–42 inches (91–107 cm) above a base surface (the floor or the bottom of the door frame 4) and serve as the sole or principal latching mechanism for the door. Alternatively, the latch of the present invention may be mounted in an elevated position, usually about 54–58 inches (137–147 cm) above the base surface, and serve as an auxiliary latch to the main door latch. This latter configuration is especially desirable when it is intended to use the latch of this invention as a safety or security latch, as around pool areas, to prevent young children from reaching and releasing the latch to open a pool door. The striker 16 will of course be aligned at an equivalent height.

It will be evident that there are numerous embodiments of this invention which, while not expressly described above, are clearly within the scope and spirit of the invention. The above description is therefore intended to be exemplary only, and the scope of the invention is to be limited solely by the appended claims.

We claim:

1. Latch apparatus for a sliding closure, said closure having a frame and a panel slidably and closably mounted in said frame, said latch apparatus comprising:

a striker mounted on one of said frame and said panel;

a housing mounted on the other of said frame and said panel in alignment with said striker, said housing having opposed faces and a peripheral wall therebetween, said faces and wall forming a chamber within said housing, and said wall having a front and a back; a first opening in the front of said wall and a second opening at least partially in the back of said wall; and spindle means and a pivot pin disposed transversely between said faces within said chamber;

an elongated latch bar having a front end and a back end and pivotally mounted on said spindle means in said chamber, with said front end projecting out of said first opening and said back end projecting out of said second opening; said front end having means therein for releasable latching engagement with said striker, said engagement being responsive to motion of said back end; and means cooperating with hold-open means for preventing said engagement with said striker;

an elongated deadbolt abutting said latch bar and having an inner end and an outer end; guiding means adjacent said inner end pivotally engaging track means in said faces of said housing to permit said deadbolt to extend and retract though said first opening; when extended to project into said striker and prevent said latch bar from pivoting on said spindle means; and when retracted to pivot when said latch bar is pivoted;

elongated hold-open means pivotally mounted on said pivot pin with a first end projecting outwardly though said second opening and a second end disposed to be pivotally moved by movement of said first end between a position of engagement with said latch bar when said latch bar is disengaged from said striker and a position of disengagement with said latch bar, said hold-open means when engaged with said latch bar preventing said latch bar from engaging said striker; and first and second resilient urging means, said first urging means urging said latch bar into a latched configuration and said second urging means urging said hold-open means into said position of disengagement.

2. Latch apparatus as in claim 1 wherein said striker has means thereon cooperative with said deadbolt to prevent said panel from being removed from said frame.

3. Latch apparatus as in claim further comprising rotating means disposed on the opposite side of said frame or panel and aligned with said housing and having tongue means extending therefrom through said frame or panel into said spindle means and rotating with said rotating means; said spindle means being rotatable and having means therein to receive said tongue means; such that rotation of said rotating means causes said spindle means to rotate and rotate said latch bar.

4. Latch apparatus as in claim 3 wherein said rotating means comprises a handle adapted to be manually manipulated to cause said rotation.

5. Latch apparatus as in claim 3 wherein said rotating means comprises a lock adapted to be manipulated by key means to cause said rotation.

6. Latch apparatus as in claim 1 wherein said housing is mounted on said panel and said striker is mounted on said frame.

7. Latch apparatus as in claim 6 further comprising a handle attached to said housing to facilitate movement of said panel.

8. Latch apparatus as in claim 1 wherein said housing is mounted within one of said panel and frame and said striker is mounted within the other of said panel and frame.

9. Latch apparatus as in claim 8 wherein said housing is mounted within said panel and said striker is mounted within said frame.

10. Latch apparatus as in claim wherein said urging means comprise springs.

11. Latch apparatus as in claim 1 wherein said housing is reversible to accommodate opposite directions of closure of said panel, said guiding means of said deadbolt being movably mounted in said deadbolt and adapted to be disposed in different positions to permit said reversibility.

12. Latch apparatus as in claim 1 wherein said housing serves as the principal latch mechanism for said closure.

13. Latch apparatus as in claim 12 wherein said housing is mounted on said closure at a height of approximately 36–42 inches above a base surface and said striker is aligned at an equivalent height.

14. Latch apparatus as in claim 1 wherein said housing serves as an auxiliary latch mechanism for said closure.

15. Latch apparatus as in claim 14 wherein said housing is mounted on said closure at a height of approximately 54–58 inches above a base surface and said striker is aligned at an equivalent height.

* * * * *